US009318068B2

(12) United States Patent
Stronks et al.

(10) Patent No.: US 9,318,068 B2
(45) Date of Patent: Apr. 19, 2016

(54) DISPLAY DRIVER PRECHARGE CIRCUITRY

(71) Applicant: APPLE INC., Cupertinio, CA (US)

(72) Inventors: David A. Stronks, San Jose, CA (US); Hopil Bae, Sunnyvale, CA (US); Kingsuk Brahma, San Francisco, CA (US); Sang Y. Youn, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 34 days.

(21) Appl. No.: 14/081,834

(22) Filed: Nov. 15, 2013

(65) Prior Publication Data

US 2014/0139415 A1 May 22, 2014

Related U.S. Application Data

(60) Provisional application No. 61/727,557, filed on Nov. 16, 2012.

(51) Int. Cl.
*G09G 3/36* (2006.01)

(52) U.S. Cl.
CPC ..... *G09G 3/3696* (2013.01); *G09G 3/3648* (2013.01); *G09G 2310/0248* (2013.01); *G09G 2330/021* (2013.01)

(58) Field of Classification Search
CPC ..... G09G 3/3614; G09G 3/3655; G09G 2310/0248; G09G 2310/0251; G09G 2310/0254; G09G 2310/0256; G09G 2300/0823; G09G 2310/068; G09G 3/3696; G09G 3/3648; G09G 3/3688; G09G 2230/021; G02F 1/13624; G06F 13/4077
USPC ..... 345/79, 87, 92, 93, 94, 95, 96, 98, 99
See application file for complete search history.

(56) References Cited

U.S. PATENT DOCUMENTS

| | | | | |
|---|---|---|---|---|
| 7,079,092 | B2 | 7/2006 | Tanghe et al. | |
| 7,859,505 | B2 * | 12/2010 | An | 345/99 |
| 8,179,392 | B2 | 5/2012 | Kida et al. | |
| 2003/0052851 | A1 * | 3/2003 | Yano | G09G 3/2011 345/89 |

(Continued)

FOREIGN PATENT DOCUMENTS

JP 2003114657 A * 4/2003 ..... G09G 3/36

OTHER PUBLICATIONS

Yuan et al.; "High-Speed CMOS Circuit Technique"; IEEE, vol. 24, pp. 62-70, Feb. 1989.

(Continued)

*Primary Examiner* — Amr Awad
*Assistant Examiner* — Kevin Yafuso
(74) *Attorney, Agent, or Firm* — Fletcher Yoder PC

(57) ABSTRACT

Systems and methods for efficiently generating display driver timing signals are provided. In one example, display driver circuitry of an electronic display may provide a negative voltage from a negative voltage supply to display control circuitry during a first period and may provide a positive voltage from a positive voltage supply to the display control circuitry during a second period. After providing the negative voltage during the first period but before providing the positive voltage during the second period, the display driver circuitry may precharge the capacitance of the display control circuitry to ground. In this way, the positive voltage supply substantially does not supply charge to raise the voltage on the capacitance of the display control circuitry from the negative voltage to ground.

14 Claims, 9 Drawing Sheets

(56) References Cited

U.S. PATENT DOCUMENTS

| | | | | |
|---|---|---|---|---|
| 2003/0067434 | A1* | 4/2003 | Haga et al. | 345/98 |
| 2004/0125067 | A1* | 7/2004 | Kim et al. | 345/98 |
| 2008/0231580 | A1* | 9/2008 | Hsu | 345/98 |
| 2009/0231321 | A1* | 9/2009 | Matsuki et al. | 345/212 |
| 2009/0322737 | A1* | 12/2009 | Kim et al. | 345/215 |
| 2010/0123693 | A1* | 5/2010 | Utsunomiya | 345/205 |
| 2011/0148893 | A1* | 6/2011 | An | G09G 3/3614 345/545 |
| 2012/0038610 | A1* | 2/2012 | Li et al. | 345/211 |
| 2013/0162304 | A1* | 6/2013 | Kim | G09G 3/3659 327/109 |
| 2013/0162618 | A1* | 6/2013 | Seo | G06F 1/26 345/212 |
| 2013/0321386 | A1* | 12/2013 | Murai et al. | 345/213 |

OTHER PUBLICATIONS

Chandrakasan et al.; "Minimizing Power Consumption in Digital CMOS Circuits"; IEEE, vol. 83, pp. 498-523, Apr. 1995.

Pagiamtzis et al.; "Content-Addressable Memory (CAM) Circuits and Architectures: A Tutorial and Survey"; IEEE, vol. 41, pp. 712-727, Mar. 2006.

* cited by examiner

DISPLAY DRIVER PRECHARGE CIRCUITRY

CROSS-REFERENCE TO RELATED APPLICATIONS

This application claims the benefit of and priority to U.S. Provisional Application No. 61/727,557, titled "DISPLAY DRIVER PRECHARGE CIRCUITRY" and filed 16 Nov. 2012, which is incorporated by reference herein in its entirety for all purposes.

BACKGROUND

This disclosure relates to display driver circuitry to generate an efficient timing signal by precharging to ground before transitioning between periods of positive voltage and negative voltage.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays appear in many electronic devices. One type of electronic display, known as a liquid crystal display (LCD), modulates light passing through pixels of various colors using a liquid crystal material. By programming the pixels to display different colors, images are generated on the display. To do so, display driver circuitry provides a gate clock signal to activate a row of pixels. While the pixels are activated, the display driver circuitry may program the pixels to display particular colors. Specifically, the display driver circuitry may receive multiplexed image data (e.g., a single signal of red, green, and blue (RGB) image data). Demultiplexers having switches clocked to demultiplexer timing signals then demultiplex the image data into separate signals of different colors (e.g., separate red, green, and blue signals). The display driver circuitry provides these demultiplexed image signals to the pixels while the pixels remain activated by the gate clock signal. After the pixels have been programmed, the gate clock signal deactivates the pixels.

The various timing signals used by the display driver circuitry may have periods of positive voltage and periods of negative voltage. In general, the switches and/or gates that receive the timing signals may be activated during positive voltage periods and deactivated during negative voltage periods, though this arrangement may be reversed. In either case, a positive voltage supply provides positive charge to cause the timing signal to reach a positive voltage, and a negative voltage supply provides negative charge to cause the timing signal to reach a negative voltage. Repeatedly and alternatingly providing the positive and negative charges to generate the timing signals used by the display driver circuitry may consume a substantial amount of power.

Moreover, the rise and fall transition time properties (e.g., slew rate) of these timing signals (e.g., the gate clock signals) may influence and affect channel charge distribution on the row of pixels being activated or deactivated. In some cases, a relatively rapid slew rate of the gate clock signals may cause certain visual artifacts, such as flicker, to occur more frequently and/or more severely. On the other hand, a slower slew rate may reduce some visual artifacts. As such, it may be desirable to design and provide an LCD display that can regulate the slew rate of gate clock signals, while also reducing the amount of power consumed by these signals.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure relate to systems and methods for efficiently generating display driver timing signals having periods of positive voltage and periods of negative voltage. Specifically, the amount of charge supplied by positive voltage supplies and negative voltage supplies may be reduced by precharging the timing signals to ground between periods of positive and negative voltage. Thus, in one example, display driver circuitry of an electronic display may provide a negative voltage from a negative voltage supply to display control circuitry during a first period and may provide a positive voltage from a positive voltage supply to the display control circuitry during a second period. After providing the negative voltage during the first period but before providing the positive voltage during the second period, the display driver circuitry may precharge the capacitance of the display control circuitry to ground. In this way, the positive voltage supply substantially does not supply charge to raise the voltage on the capacitance of the display control circuitry from the negative voltage to ground. Compared to timing circuitry that switches directly between the positive voltage and the negative voltage, the timing circuitry of this disclosure may offer substantial efficiencies. Indeed, the timing circuitry of this disclosure may consume roughly half the power consumed by timing circuitry that switches directly between the positive voltage and the negative voltage.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
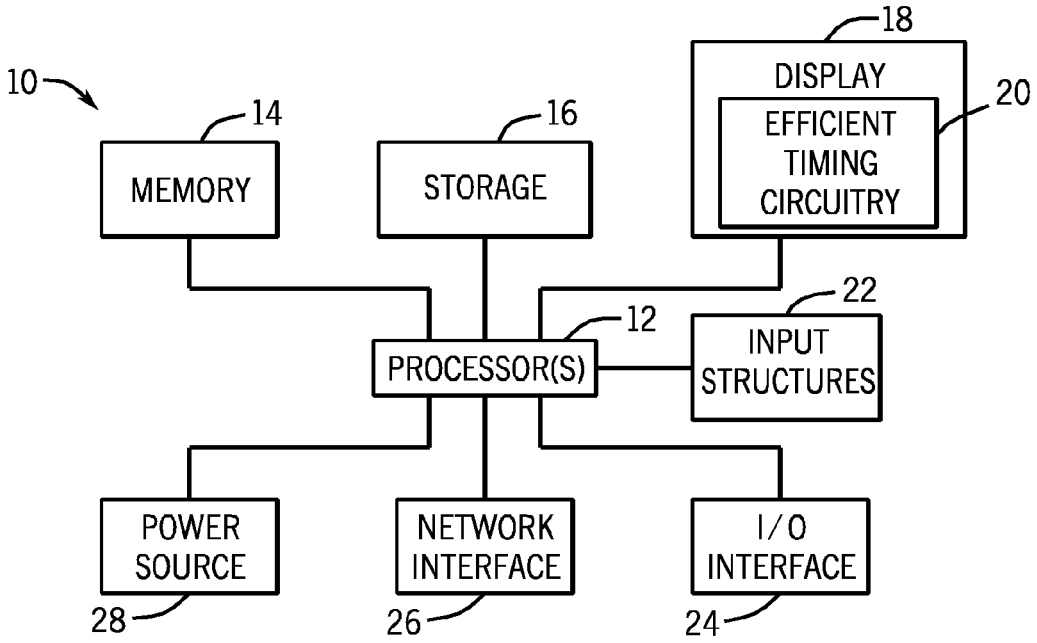
FIG. 1 is a block diagram of an electronic device that employs efficient display timing circuitry by precharging to ground between positive and negative voltage periods of a timing signal, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

This disclosure relates to circuitry to efficiently provide timing signals in an electronic display. Specifically, display driver circuitry may provide timing signals to control a variety of different elements of an electronic display. For example, a gate clock signal may control when individual pixels of the electronic display are activated. In one example, a voltage level higher than ground may be used to activate gates of thin film transistors (TFTs) of a row of pixels to activate the pixels while they are programmed with image data signals. To deactivate the pixels, the gate clock signal may be reduced to a voltage level lower than ground. Rather than switch directly between the voltages level higher than ground (VGH) and the voltage level lower than ground (VGL), the gate clock signal may be precharged (also referred to as "discharged" in this disclosure) to ground between these transitions. As will be described below, precharging to ground rather than switching directly between the higher voltage VGH and the lower voltage VGL, and vice versa, may provide power savings of approximately 50% over circuits that do not precharge to ground between higher and lower voltages.

Such efficient timing circuitry may also enable slew rate control. As used herein, slew rate refers to the transition time between the higher voltage VGH and the lower voltage VGL, and vice versa. Since the slew rate may impact the performance of the display (e.g., an especially high slew rate may result in flicker or other artifacts), the display driver circuitry of this disclosure may additionally include slew rate control circuitry. The slew rate control circuitry may operate in cooperation with the precharge circuitry.

Finally, this disclosure tends to describe efficient timing circuitry for use with a liquid crystal display (LCD). However, the efficient timing circuitry may be employed using any suitable type of electronic display. For example, other electronic displays that employ a matrix of pixels, such as organic light emitting diode (OLED) displays, may also employ the efficient timing circuitry of this disclosure.

Figure 2:
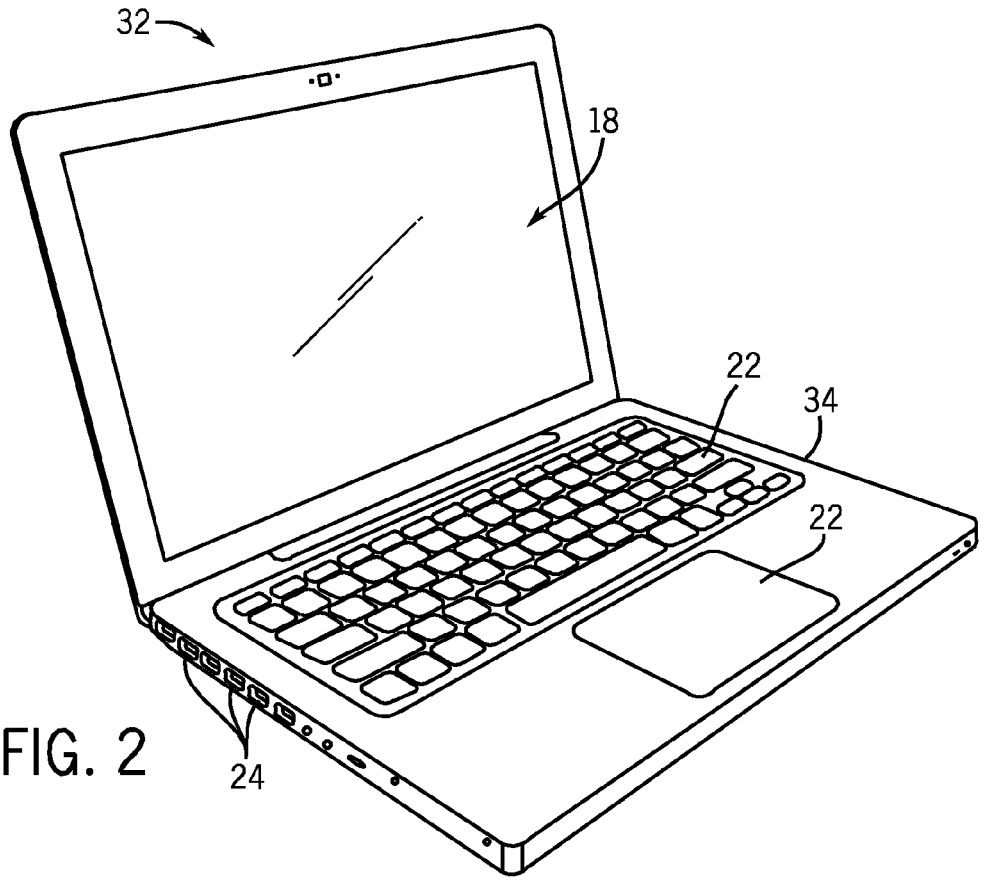
FIG. 2 is a perspective view of the electronic device of FIG. 1 in the form of a notebook computer, in accordance with an embodiment.
Figure 3:
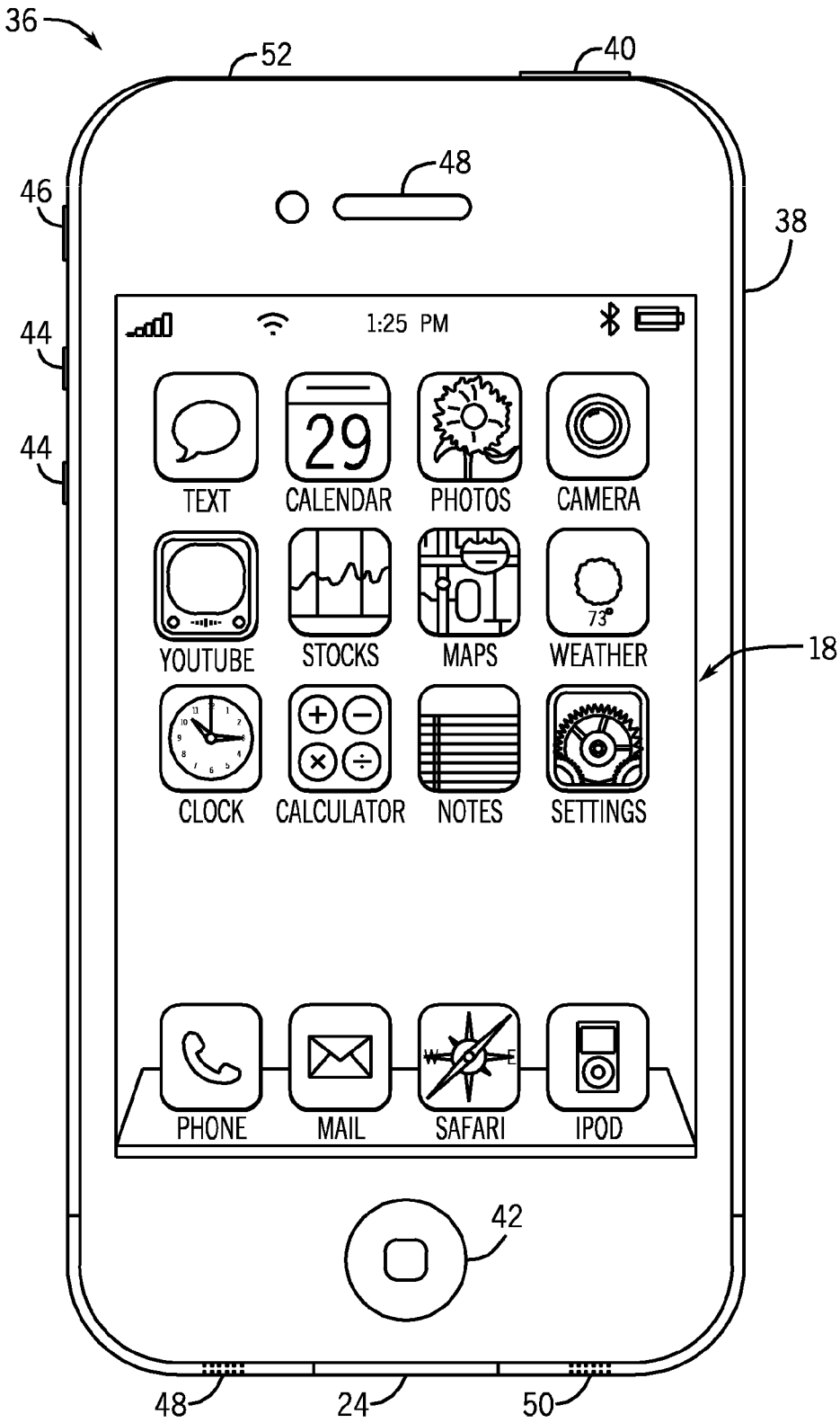
FIG. 3 is a front view of the electronic device of FIG. 1 in the form of a handheld device, in accordance with an embodiment.

Indeed, many suitable electronic devices may use electronic displays that include efficient timing circuitry. For example, FIG. 1 is a block diagram depicting various components that may be present in an electronic device suitable for use with such a display. FIGS. 2 and 3 respectively illustrate perspective and front views of suitable electronic devices. Specifically, FIGS. 2 and 3 illustrate a notebook computer and a handheld electronic device, respectively.

Turning first to FIG. 1, an electronic device 10 according to an embodiment of this disclosure may include, among other things, one or more processor(s) 12, memory 14, nonvolatile storage 16, a display 18 that includes efficient timing circuitry 20, input structures 22, an input/output (I/O) interface 24, network interfaces 26, and/or a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in the electronic device 10.

By way of example, the electronic device 10 may represent a block diagram of the notebook computer of FIG. 2, the handheld device of FIG. 3, or similar devices. In the electronic device 10 of FIG. 1, the processor(s) 12 and/or other data processing circuitry may be operably coupled with the memory 14 and the nonvolatile memory 16 to execute instructions. For instance, the processor(s) 12 may generate image data to be displayed on the display 18. The display 18 may be a touch-screen liquid crystal display (LCD). In some embodiments, the electronic display 18 may be a Multi-Touch™ display that can detect multiple touches at once. The display 18 may use the efficient timing circuitry 20 to control the display while reducing the amount of power consumed by the display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter.

The electronic device 10 may take the form of a computer or other suitable type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 32, is illustrated in FIG. 2 in accordance with one embodiment of this disclosure. The depicted computer 32 may include a housing 34, a display 18, input structures 22, and ports of an I/O interface 24. In one embodiment, the input structures 22 (such as a keyboard and/or touchpad) may be used to interact with the computer 32, such as to start, control, or operate a GUI or applications running on computer 32. The display 18 may use the efficient timing circuitry 20 to generate internal timing signals. The efficient timing circuitry 20 of the display 18 reduces power consumption by precharging the timing signal to ground between higher voltage and lower voltage periods.

FIG. 3 depicts a front view of a handheld device 36, which represents one embodiment of the electronic device 10. The handheld device 36 may represent, for example, a portable phone, a media player, a personal data organizer, a handheld game platform, or any combination of such devices. By way of example, the handheld device 36 may be a model of an iPod® or iPhone® available from Apple Inc. of Cupertino, Calif. In other embodiments, the handheld device 36 may be a tablet-sized embodiment of the electronic device 10, which may be, for example, a model of an iPad® available from Apple Inc.

The handheld device 36 may include an enclosure 38 to protect interior components from physical damage and to shield them from electromagnetic interference. The enclosure 38 may surround the display 18. The I/O interfaces 24 may open through the enclosure 38 and may include, for example, a proprietary I/O port from Apple Inc. to connect to external devices. User input structures 40, 42, 44, and 46, in combination with the display 18, may allow a user to control the handheld device 36. For example, the input structure 40 may activate or deactivate the handheld device 36, the input structure 42 may navigate a user interface to a home screen, a user-configurable application screen, and/or activate a voice-recognition feature of the handheld device 36, the input structures 44 may provide volume control, and the input structure 46 may toggle between vibrate and ring modes. A microphone 48 may obtain a user's voice for various voice-related features, and a speaker 50 may enable audio playback and/or certain phone capabilities. A headphone input 52 may provide a connection to external speakers and/or headphones. The display 18 of the handheld device 36 may also use the efficient timing circuitry 20 to generate internal timing signals. The efficient timing circuitry 20 of the display 18 reduces power consumption by precharging the timing signal to ground between higher voltage and lower voltage periods.

Figure 4:
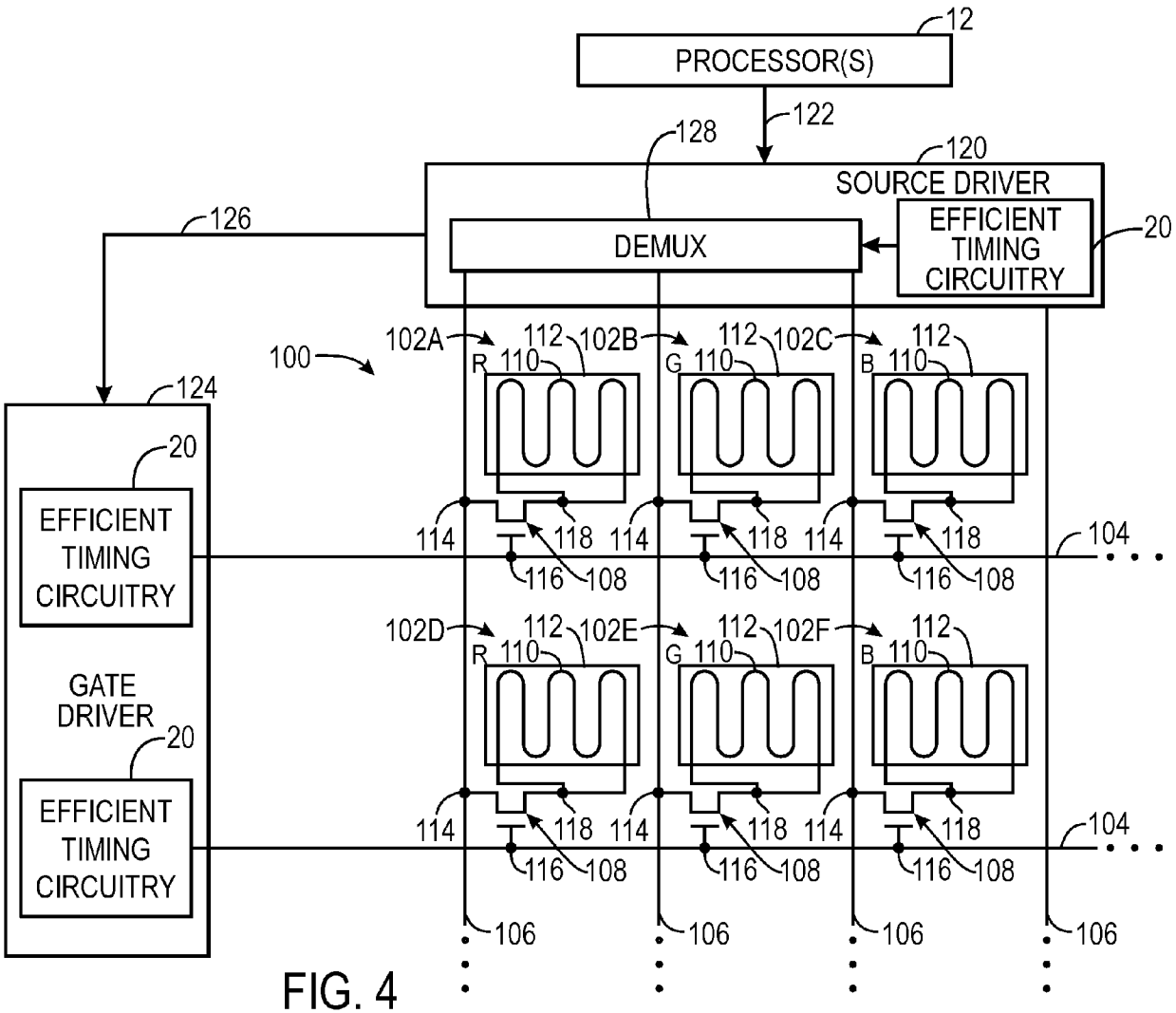
FIG. 4 is a circuit diagram of display driver circuitry of the display that uses the efficient timing circuitry, in accordance with an embodiment.

The display 18 may operate by activating and programming a number of picture elements, or pixels. These pixels may be generally arranged in a pixel array 100, as shown in FIG. 4. The pixel array 100 of the display 18 may include a number of unit pixels 102 disposed in a pixel array or matrix. In the pixel array 100, each unit pixel 102 may be defined by an intersection of gate lines 104 (also referred to as scanning lines) and source lines 106 (also referred to as data lines). Although only six unit pixels 102 are shown (102A-102F), it should be understood that in an actual implementation, the pixel array 100 may include hundreds, thousands, or millions of such unit pixels 102. Each of the unit pixels 102 may represent one of three subpixels that respectively filter only one color (e.g., red, blue, or green) of light. For purposes of this disclosure, the terms "pixel," "subpixel," and "unit pixel" may be used largely interchangeably.

In the example of FIG. 4, each unit pixel 102 includes a thin film transistor (TFT) 108 for switching a data signal supplied to a respective pixel electrode 110. The potential stored on the pixel electrode 110 relative to a potential of a common electrode 112 may generate an electrical field sufficient to alter the arrangement of a liquid crystal layer of the display 18. When the arrangement of the liquid crystal layer changes, the amount of light passing through the pixel 102 also changes. A source 114 of each TFT 108 may connect to a source line 106 and a gate 116 of each TFT 108 may connect to a gate line 104. A drain 118 of each TFT 108 may connect to a respective pixel electrode 110. Each TFT 108 may serve as a switching element that may be activated and deactivated by a scanning or activation signal on the gate lines 104.

When activated, a TFT 108 may pass the data signal from its source line 106 onto its pixel electrode 110. As noted above, the data signal stored by the pixel electrode 110 may be used to generate an electrical field between the respective pixel electrode 110 and a common electrode 112. This electrical field may align the liquid crystal molecules within the liquid crystal layer to modulate light transmission through the pixel 102. Thus, as the electrical field changes, the amount of light passing through the pixel 102 may increase or decrease. In general, light may pass through the unit pixel 102 at an intensity corresponding to the applied voltage from the source line 106.

These signals and other operating parameters of the display 18 may be controlled by integrated circuits (ICs) of the display 18. These driver ICs of the display 18 may include a processor, microcontroller, or application specific integrated circuit (ASIC). The driver ICs may be chip-on-glass (COG) components on a TFT glass substrate, components of a display flexible printed circuit (FPC), and/or components of a printed circuit board (PCB) that is connected to the TFT glass substrate via the display FPC. Further, the driver ICs of the display 18 may include any suitable article of manufacture having one or more tangible, computer-readable media for storing instructions that may be executed by the driver ICs.

For instance, a source driver integrated circuit (IC) 120 may receive image data 122 from the processor(s) 12 and send corresponding image signals to the unit pixels 102 of the pixel array 100. The source driver 120 may also couple to a gate driver integrated circuit (IC) 124 that may activate or deactivate rows of unit pixels 102 via the gate lines 104. As such, the source driver 120 may provide some timing signals 126 to the gate driver 124 to facilitate the activation and/or deactivation of individual lines (e.g., rows or columns) of pixels 102. In other embodiments, timing information may be provided to the gate driver 124 in some other manner. In the illustrated example, the gate driver 124 uses efficient timing circuitry 20 to generate the gate clock signals provided over the gate lines 104.

The source driver IC 120 may also use the efficient timing circuitry 20 to generate timing signals for demultiplexers 128. The source driver IC 120 may include a vast number of demultiplexers 128, which may demultiplex the image data 122 that is subsequently provided to the source lines 106. The number of demultiplexers 128 of the display 18 may be equal to the number of groupings of subpixels used to collectively generate a particular color in each line (e.g., several hundred or several thousand). The demultiplexers 128 may demultiplex RGB image data 122, for example, into three separate demultiplexed components of red, green, and blue, each demultiplexer 128 doing so using three respective switches. As such, though not expressly pictured in FIG. 4, the efficient timing circuitry 20 may provide three separate timing signals to all of the demultiplexers 128 of the display 18, one timing signal for each of the three switches of the demultiplexers 128.

Figure 5:
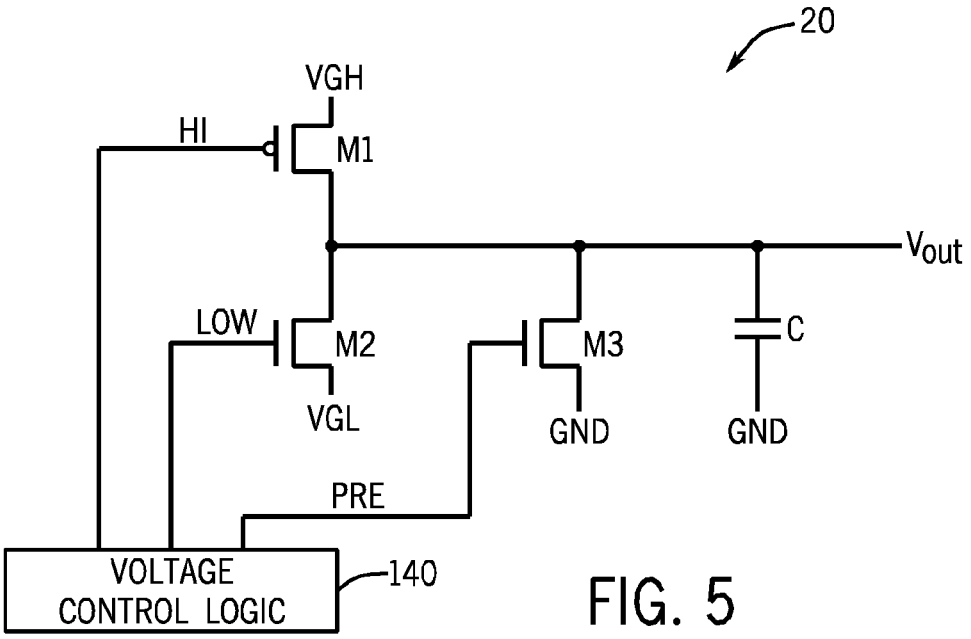
FIG. 5 is a circuit diagram of the efficient timing circuitry, in accordance with an embodiment.

One example of the efficient timing circuitry 20 appears in FIG. 5. In the example of FIG. 5, the timing signal is equal to the output voltage Vout. The output voltage Vout may be understood to be provided to display control circuitry of the display panel pixel array 100 (e.g., the gates 116 of the pixels 102) or of the display driver circuitry (e.g., the switches of the demultiplexers 128). Such display control circuitry is represented in FIG. 5 as a capacitance C. The capacitance C may vary depending on the characteristics of the display control circuitry to which the output voltage Vout is provided.

At any one time, the output voltage of the efficient timing circuitry 20 is either a higher voltage VGH, a lower voltage VGL, or ground GND. The higher voltage VGH is higher than ground GND and the lower voltage VGL is lower than ground GND. The efficient timing circuitry 20 includes a transistor M1 that provides the higher voltage VGH to the output voltage Vout, a transistor M2 that provides the lower voltage VGL to the output voltage Vout, and a transistor M3 that provides the ground GND to the output voltage Vout. In the example of FIG. 5, the transistor M1 is a PMOS transistor while the transistors M2 and M3 are NMOS transistors. In other embodiments, however, the transistors M1, M2, and M3 may be any other suitable switches.

Voltage control logic 140 may control the output voltage Vout of the efficient timing circuitry 20 by selectively activating and deactivating the transistors M1, M2, and M3. These are shown to be a first signal HI to control the transistor M1, a second signal LOW to control the transistor M2, and a third signal PRE to control the third transistor M3. The voltage control logic 140 may represent any suitable logic to generate the timing signals on the output voltage Vout a discussed in this disclosure. In some examples, the voltage control logic 140 may represent instructions executed on the processor(s) 12 of the electronic device 10 in which the electronic display 18 is installed. In other examples, the voltage control logic 140 may represent instructions executed on a processor (e.g., a microcontroller) of the electronic display 18. In still other embodiments, the voltage control logic 18 may represent logic coded in hardware, such as a component of an applicant-specific integrated circuit (ASIC).

Figure 6:
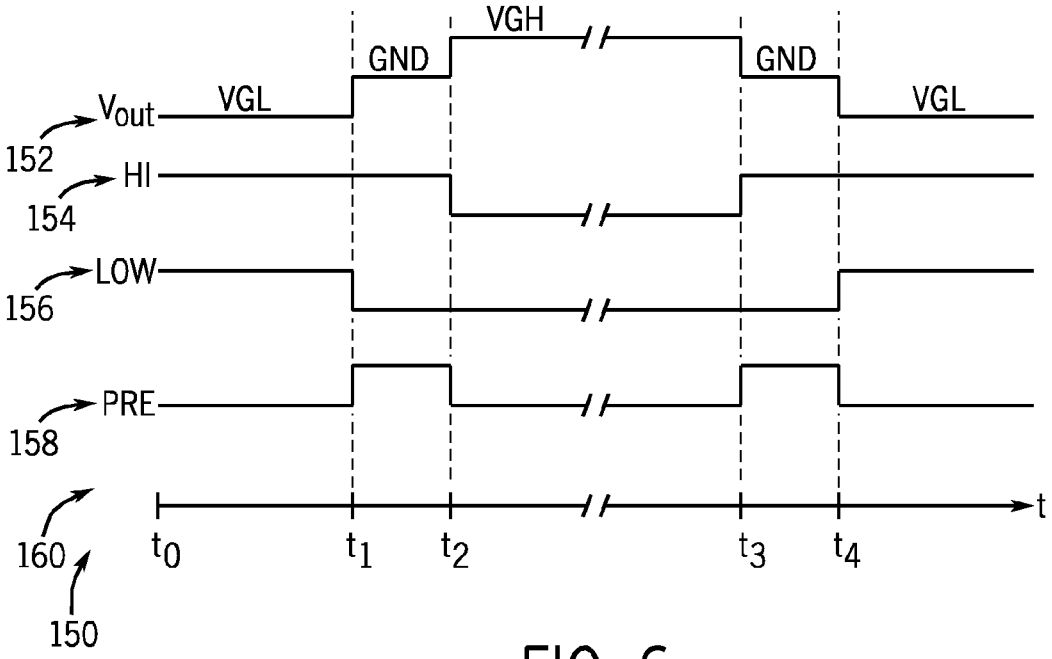
FIG. 6 is a timing diagram for controlling the circuitry of FIG. 5 to precharge to ground while transitioning between a higher voltage VGH and a lower voltage VGL, in accordance with an embodiment.
Figure 7:
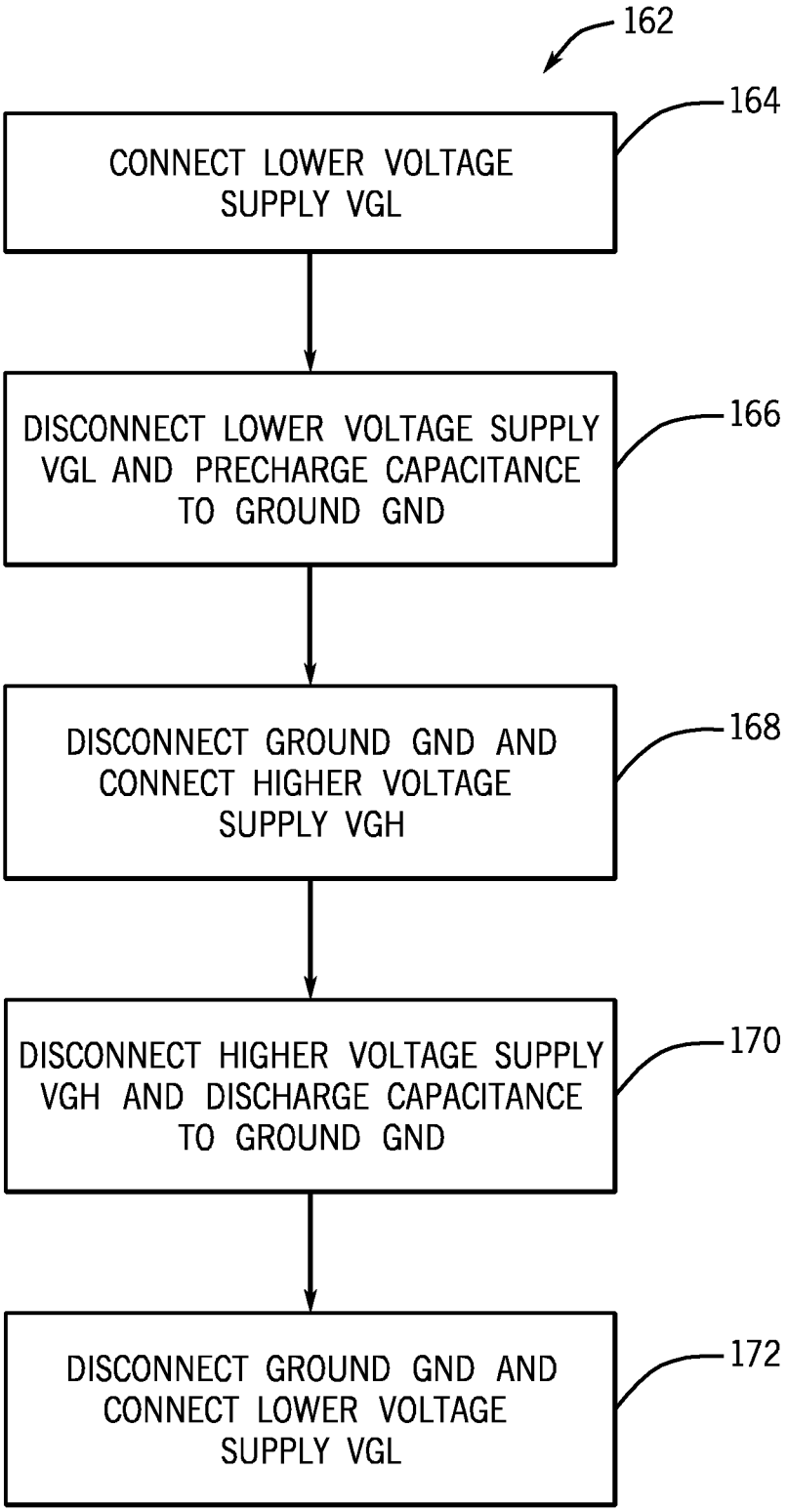
FIG. 7 is a flowchart of a method for controlling the circuitry of FIG. 5, in accordance with an embodiment.

The voltage control logic 140 may vary the output of the HI, LOW, and PRE control signals to efficiently alternate the voltage provided to the output voltage Vout between the high voltage VGH and the low voltage VGL, as illustrated in FIGS. 6 and 7. Both FIGS. 6 and 7 will be described together for ease of explanation. FIG. 6 represents a timing diagram 150, in which a plot 152 shows the output voltage Vout, a plot 154 shows the HI control signal, a plot 156 shows the LOW signal, a plot 158 shows the PRE signal, and a timeline 160 illustrates time. FIG. 7 represents a flowchart 162 that describes how the voltage control logic 140 may generate the output voltage Vout as shown in the timing diagram 150.

Specifically, the voltage control logic 140 may cause the lower voltage VGL supply to provide a negative voltage to display control circuitry (e.g., gates 116 of pixels 102) or of the display driver circuitry (e.g., the switches of the demultiplexers 128), represented as the capacitance C (block 164 of FIG. 7). Indeed, as seen at the start of the timing diagram 150 of FIG. 6, the output voltage Vout is at the lower voltage VGL from time $t_0$ to until time $t_1$. Thus, during this lower voltage period, the LOW signal is at a logic high, causing the NMOS transistor M2 to be activated and connecting the capacitance C to the lower voltage VGL supply. Meanwhile, the HI control signal is at a logic high to cause the PMOS transistor M1 to be deactivated. Likewise, the PRE control signal is at a logic low, causing the NMOS transistor M3 to be deactivated as well. Thus, from the time $t_0$ to the time $t_1$, substantially only the transistor M2 is activated.

The voltage control logic 140 next may disconnect the lower voltage VGL supply and precharge the capacitance C to ground (block 166 of FIG. 7). For example, as seen in the timing diagram 150 of FIG. 6, the NMOS transistor M2 is deactivated (LOW is set to a logic low) and the NMOS transistor M3 is activated (PRE is set to a logic high) between time $t_1$ and time $t_2$. This allows the capacitance C to precharge to ground GND.

After this precharge period, the voltage control logic 140 may disconnect ground and connect the higher voltage VGH supply to the output voltage Vout for a subsequent higher voltage period (block 168 of FIG. 7). The higher voltage period may begin at time $t_2$ of the timing diagram 150 of FIG. 6, in which the NMOS transistor M3 is deactivated by the PRE control signal and the PMOS transistor M1 become activated as the HI control signal becomes a logic LOW. Thus, from time $t_2$ to time $t_3$, substantially only the PMOS transistor M1 is activated and the resulting output voltage Vout is the higher voltage VGH.

The voltage control logic 140 next may cause the efficient timing circuitry 20 to perform a discharging process over a discharge period, by disconnecting the higher voltage VGH supply and reconnecting to ground GND (block 170 of FIG. 7). In the timing diagram 150 of FIG. 6, the discharge period may occur from time $t_3$ to time $t_4$. Over this time period, the PMOS transistor M1 is deactivated and the NMOS transistor M3 activated once more. From the time $t_3$ to time $t_4$, substantially only the NMOS transistor M3 may be activated and the capacitance C may be discharged to ground GND. The process may repeat as the voltage control logic disconnects the output voltage Vout from ground GND, connecting instead the lower voltage VGL supply to begin another lower voltage period (block 172 of FIG. 7). The subsequent lower voltage period is shown in the timing diagram 150 of FIG. 6 as beginning at time $t_4$. As can be seen, the NMOS transistor M3 may be deactivated and the NMOS transistor M2 activated once again, bringing the output voltage Vout back to VGL.

By precharging and/or discharging the capacitance C to ground between transitions between the lower voltage VGL and the higher voltage VGH, a substantial amount of power may be saved. First, this disclosure will consider the case in which the capacitance C is not precharged or discharged to ground GND between periods of higher voltage VGH and lower voltage VGL. As VGL is a voltage lower than ground GND, it should be noted that VGL is a negative voltage. The total power consumed under these circumstances may be described by equations 1-4 below. Without first precharging to ground, the amount of charge Q1 sourced from the higher voltage VGH supply, per cycle, could be described as follows:

$$Q1=C(\mathrm{VGH}-\mathrm{VGL}) \quad (1).$$

Without first discharging to ground, the amount of charge Q2 sunk into the lower voltage VGL supply, per cycle, could be described as follows:

$$Q2=C(\mathrm{VGH}-\mathrm{VGL}) \quad (2).$$

As such, without precharging and discharging to ground between outputting the higher voltage VGH and lower voltage VGL, the total amount of energy consumed per cycle W could be described as follows:

$$W=Q1*VGH+Q2*(-VGL)=C*(VGH-VGL)^2 \quad (3).$$

In an example in which the magnitude of the lower voltage VGL is the same as the higher voltage VGH, the energy consumed per cycle W without precharging or discharging to ground could be described as follows:

$$W=4*C*VGH^2 \quad (4).$$

Precharging and/or discharging to ground as described in this disclosure, however, may offer substantial power savings. When the efficient timing circuitry 20 precharges and discharges to ground between transitions, the total amount of charge Q1 sourced from the higher voltage VGH supply per cycle may be lower:

$$Q1=C*(VGH-0) \quad (5).$$

The total amount of charge Q2 sunk into the lower voltage VGL supply per cycle may also be lower:

$$Q2=C*(0-VGL) \quad (6).$$

As such, the amount of energy per cycle W consumed by the higher voltage VGH supply and the lower voltage VGL supply may be:

$$W=Q1*VGH+Q2*(-VGL)=C*(VGH^2+VGL^2) \quad (7).$$

Thus, when the magnitude of the lower voltage VGL supply is the same as the higher voltage VGH supply, the total amount of energy consumed per cycle W may be:

$$W=2*C*VGH^2 \quad (8).$$

By comparing equation 8 to equation 4, it can be seen that the efficient timing circuitry 20 of FIG. 5 may offer power savings of up to 50% in some examples.

Figure 8:
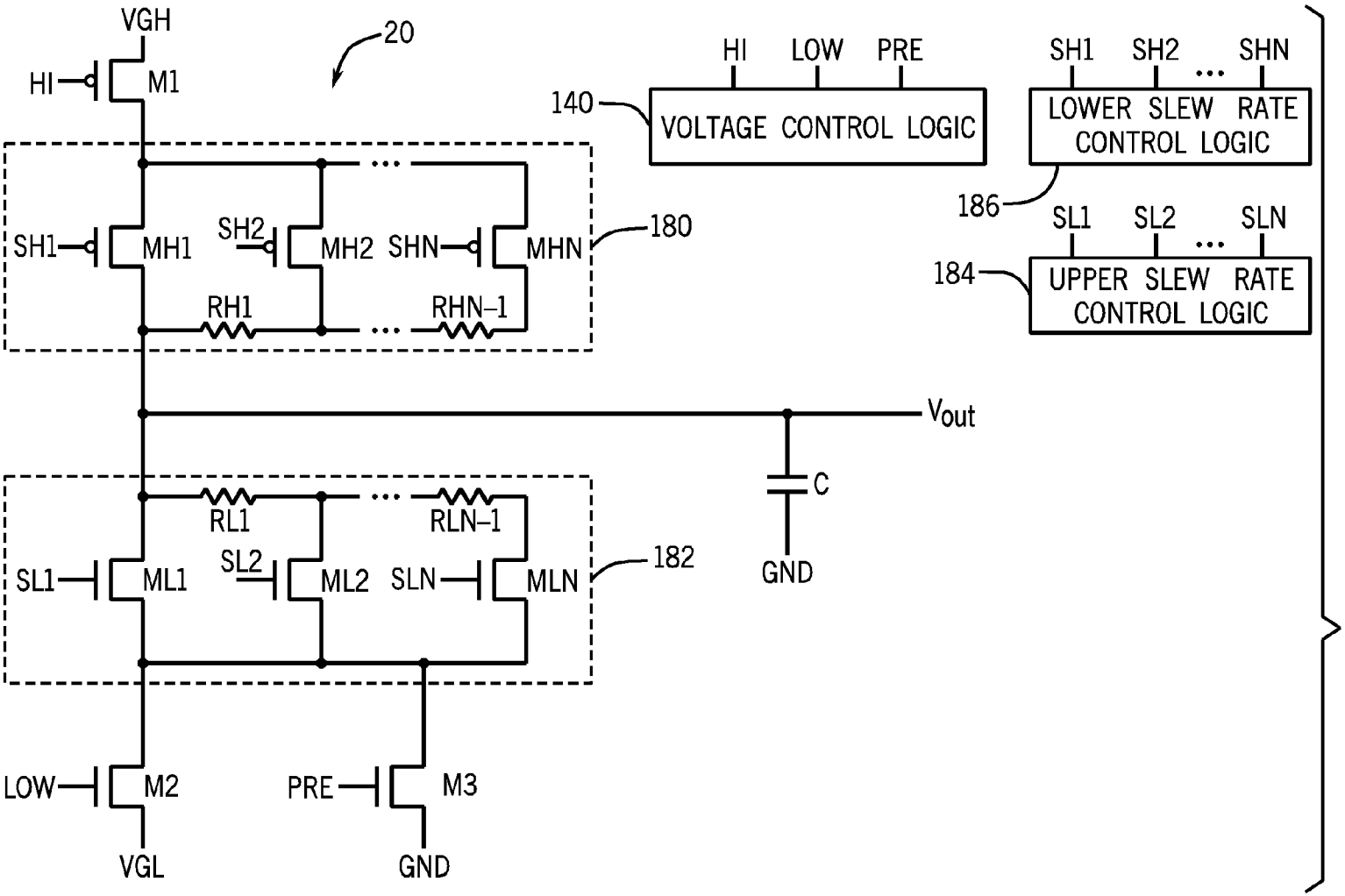
FIG. 8 is a circuit diagram of the efficient timing circuitry that includes slew rate control circuitry, in accordance with an embodiment.

Different examples of the efficient timing circuitry 20 may also control the slew rate—the rise and fall times—of the timing signal provided as the output voltage Vout. For instance, as seen in FIG. 8, the efficient timing circuitry 20 may additionally include first slew rate control circuitry 180 and second slew rate control circuitry 182. The first slew rate control circuitry 180 may couple an output of the PMOS transistor M1 to the output voltage Vout. The second slew rate control circuitry 182 may couple the outputs of the transistors M2 and M3 to the output voltage Vout. Both the first slew rate control circuitry 180 and the second slew rate control circuitry 182 may include a number of slew rate control switches coupled in parallel (e.g., MH1, MH2, . . . , MHN, and ML1, ML2, . . . , MLN) and a number of resistors (e.g., RH1, RH2, . . . , RHN−1, and RL1, RL2, . . . , RLN−1). Each of the switches of the slew rate control circuitry 180 and 182 are coupled so as to provide different resistances when different switches are activated. In the first slew rate control circuitry 180, the slew rate control switches MH1, MH2, . . . , MHN are PMOS transistors, and in the slew rate control circuitry 182, the slew rate control switches ML1, ML2, . . . , MLN are NMOS transistors, but other embodiments may employ any other suitable switches. Any suitable number of switches and resistors may be used to achieve a desired slew rate resolution.

Upper slew rate control logic 184 provides control signals SH1, SH2, . . . , SHN to respectively control the slew rate control switches MH1, MH2, . . . , MHN. Lower slew rate control logic 186 provides control signals SL1, SL2, . . . , SLN to respectively control the slew rate control switches ML1, ML2, . . . , MLN. The upper slew rate control logic 184 and the lower slew rate control logic 186 may control the rise and fall times of the output voltage Vout by gradually reducing the amount of resistance to the output voltage Vout.

Figure 9:
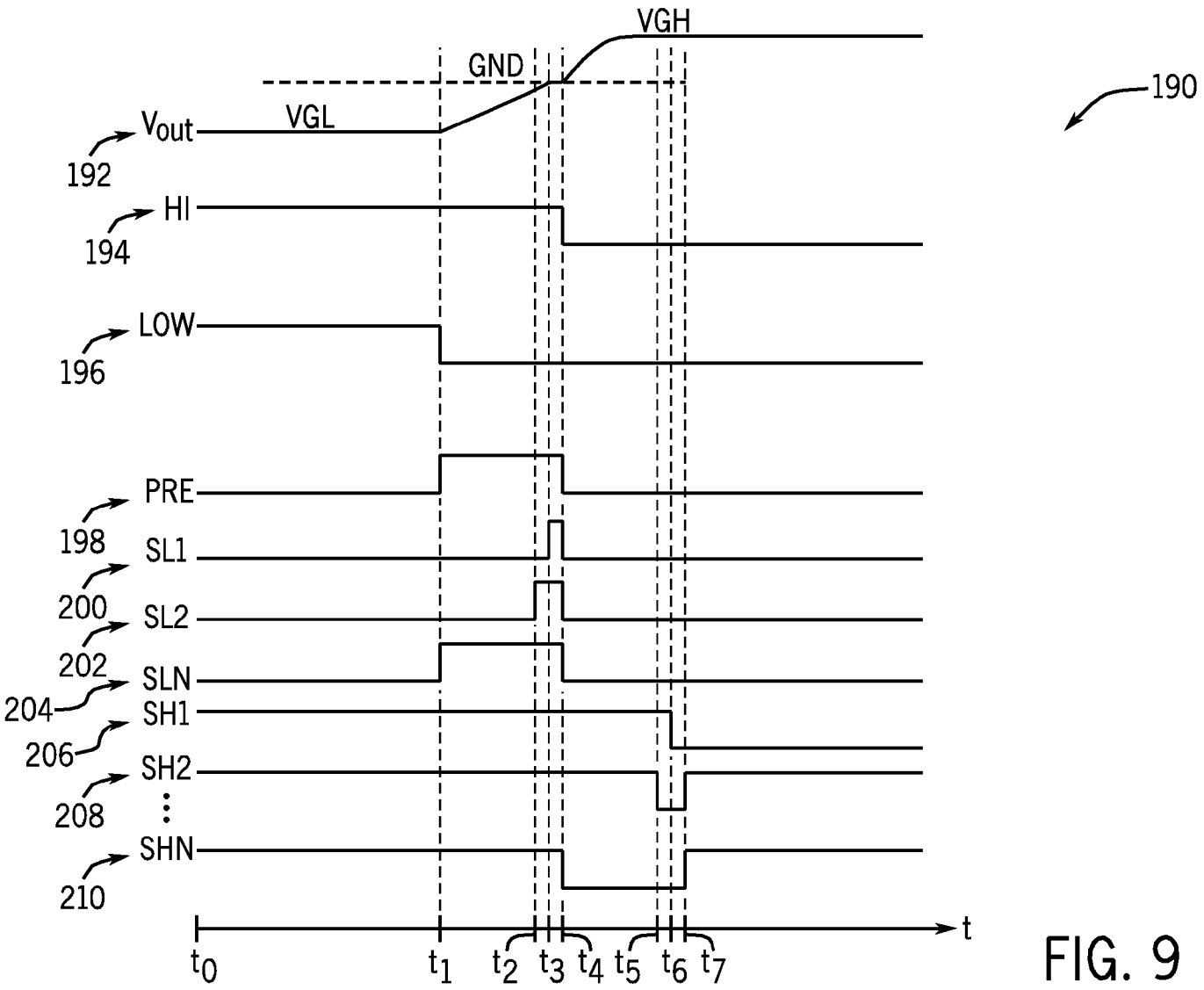
FIG. 9 is a timing diagram illustrating a manner of controlling the circuitry of FIG. 8 to provide a desired slew rate while precharging to ground, in accordance with an embodiment.

An example of controlling the slew rate using the upper slew rate control logic 184 and the lower slew rate control logic 186 appears in a timing diagram 190 of FIG. 9. In the timing diagram 190, a plot 192 represents the output voltage Vout, a plot 194 represents the voltage control signal HI, a plot 196 represents the voltage control signal LOW, a plot 198 represents the voltage control signal PRE, a plot 200 represents the slew rate control signal SL1, a plot 202 represents the slew rate control signal SL2, a plot 204 represents the slew rate control signal SLN, a plot 206 represents the slew rate control signal SH1, a plot 208 represents the slew rate control signal SH2, and a plot 210 represents the slew rate control signal SHN.

As seen in the timing diagram 190, when the output voltage Vout is to be precharged to ground, the lower slew rate control logic 186 may control the rise time of the output voltage Vout. Specifically, once the PRE signal goes high (at time $t_1$) and activates the NMOS transistor M3, the lower slew rate control logic 186 may progressively cause the slew rate control signals SLN, SL2, and SL1 to become high (at times $t_1$, $t_2$, and $t_3$), thereby activating the corresponding slew rate control switches MLN, ML2, and ML1, and gradually reducing the number of resistors between the ground voltage GND and the output voltage Vout. As this resistance decreases, the output voltage Vout increases accordingly. At time $t_4$, the PRE signal may go low, as may the slew rate control signals SLN, SL2, and SL1.

The upper slew rate control circuitry 184 may thereafter control the rise time of the output voltage Vout. Namely, at time $t_4$, the voltage control signal HI may go low, activating the PMOS transistor M1. The upper slew rate control logic 184 may progressively cause the slew rate control signals SHN, SH2, and SH1 to become low (at times $t_4$, $t_5$, and $t_6$), thereby activating the corresponding slew rate control switches MHN, MH2, and MH1, and gradually reducing the number of resistors between the higher voltage VGH and the output voltage Vout. As this resistance decreases, the output voltage Vout increases accordingly. At time $t_7$, the slew rate control signals other than SH1 may be switched to a logic high, thereby deactivating the all but the transistor MH1 for the remaining duration of the higher voltage period. It should be appreciated that a similar process may take place to control the fall time when transitioning from the higher voltage period to the ground discharge period to the lower voltage period, except that only the lower slew rate control circuitry 182 may be used.

Figure 10:
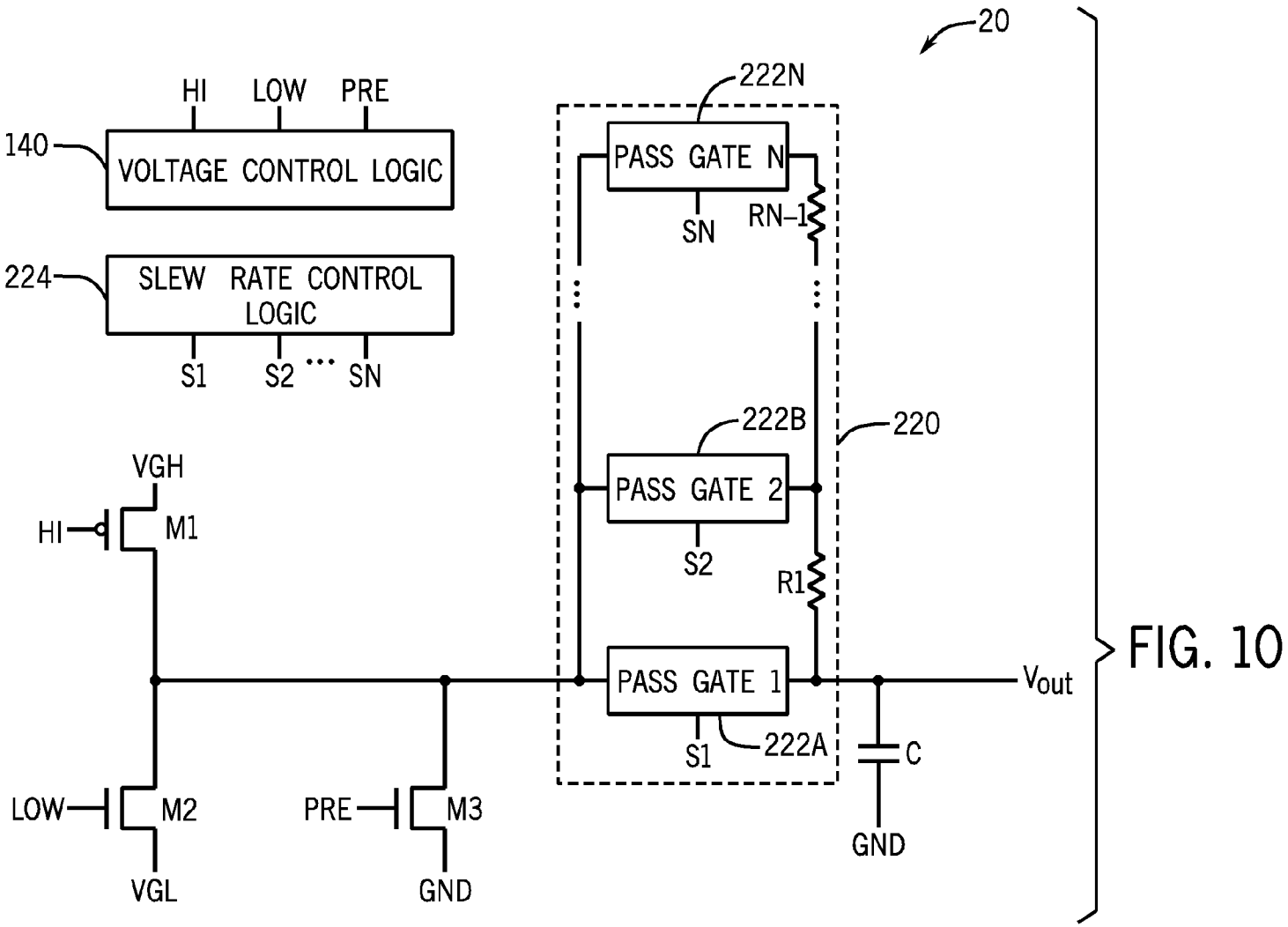
FIG. 10 is a circuit diagram of another example of efficient timing circuitry that includes slew rate control circuitry, in accordance with an embodiment.

The efficient timing circuitry 20 may, additionally or alternatively, employ shared slew rate control circuitry 220 as shown in FIG. 10. In the example of FIG. 10, the voltage control logic 140 controls the voltage control transistors M1, M2, and M3 using the HI, LOW, and PRE signals, respectively, as described above. The voltage control transistors M1, M2, and M3 share a common output that connects to shared slew rate circuitry 220. The shared slew rate control circuitry 220 may include any suitable number of pass-gate switches 222A, 222B, . . . , 222N, which may receive slew rate control signals S1, S2, . . . , SN, respectively (and/or the inverse of these signals). The shared slew rate control circuitry 220 also includes any suitable number and values of resistors R1, R2, . . . , RN−1). Each of the switches of the shared slew rate control circuitry 220 are coupled so as to to provide different resistances when different switches are activated.

Shared slew rate control logic 224 may provide the slew rate control signals S1, S2, . . . , SN. The shared slew rate control logic 224 may be implemented as instructions running on the processor(s) 12 or a microcontroller of the electronic display 18, and/or which may be hardware (e.g., a component of an application specific integrated circuit (ASIC)). The shared slew rate control logic 224 may control the slew rate of the timing signal output as the output voltage Vout in any suitable way, including as generally described above with reference to the timing diagram 190 of FIG. 9.

Figure 11:
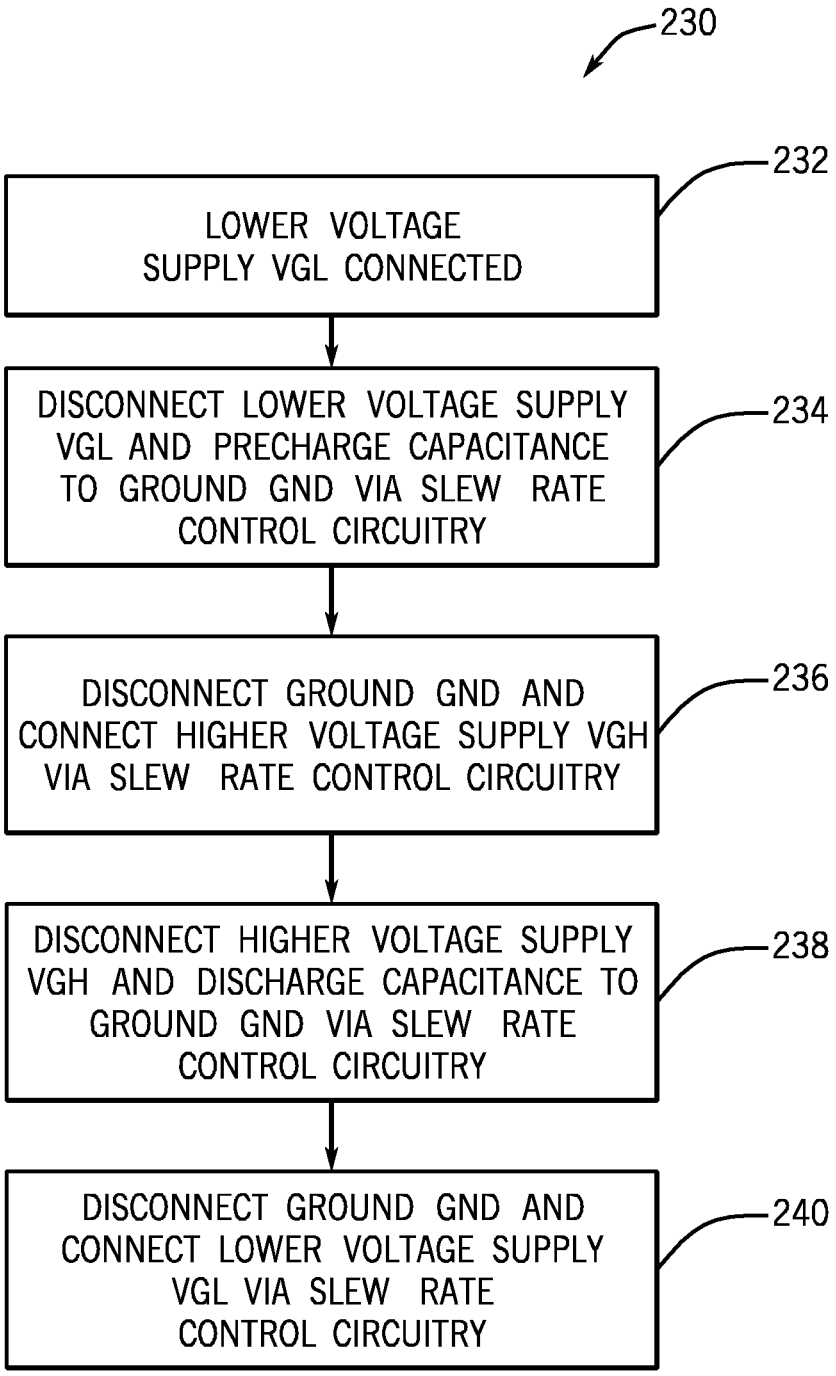
FIG. 11 is a flowchart of a method for controlling the timing circuitry of FIG. 8 or 10, in accordance with an embodiment.

Whether the efficient timing circuitry 20 includes the first and second slew rate control circuitry 180 and 182, or the shared slew rate control circuitry 220, the efficient timing circuitry 20 may provide a timing signal having a desired slew rate. One method of doing so appears as a flowchart 230 of FIG. 11. The flowchart 230 may begin when the lower voltage VGL supply is currently being provided as the output voltage Vout over a lower voltage period (block 232). The lower voltage VGL supply next may be disconnected and the capacitance C may be precharged to ground via the second slew rate control circuitry 182 or the shared slew rate control circuitry 220 (block 234). During this precharge period, the second slew rate control circuitry 182 or the shared slew rate control circuitry 220 may control a rise time from the lower voltage VGL to ground GND. Ground then may be disconnected and the higher voltage VGH supply connected via the first slew rate control circuitry 180 or the shared slew rate control circuitry 220 (block 236). The first slew rate control circuitry 180 or the shared slew rate control circuitry 220 may control a rise time from ground GND to the higher voltage VGH as desired, before the higher voltage VGH is maintained for the duration of a higher voltage period of the timing signal.

After the higher voltage period, the higher voltage VGH supply may be disconnected, and ground GND may be connected via the second slew rate control circuitry 180 or the shared slew rate control circuitry 220 during a discharge period (block 238). The second slew rate control circuitry 180 or the shared slew rate control circuitry 220 may control a fall time from the higher voltage VGH to ground GND. Following the discharge period, ground GND may be disconnected and the lower voltage VGL supply may be connected via the second slew rate control circuitry 180 or the shared slew rate control circuitry 220 (block 240). The second slew rate control circuitry 180 or the shared slew rate control circuitry 220 may control a fall time from ground GND to the lower voltage VGL. Thereafter, the output voltage Vout may be maintained at the lower voltage VGL for the duration of this subsequent lower voltage period.

Technical effects of this disclosure include a substantial power savings by precharging and/or discharging a timing signal to ground between periods of output voltages higher than ground and output voltages lower than ground. In addition, by controlling the slew rate of the output voltage, certain display panel properties may be controlled despite the reduction in power consumption. In some instances, power consumption due to certain timing signals may be reduced by up to half.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic display comprising:

a display panel;

display driver circuitry configured to drive the display panel, wherein the display driver circuitry comprises timing circuitry configured to output a timing signal to circuitry of the display panel or circuitry of the display driver circuitry via an output node, wherein the output node has a capacitance, wherein the timing circuitry is configured to generate the timing signal such that the timing signal comprises:

lower voltage periods, during which the timing signal provided to the output node is at a voltage lower than ground;

higher voltage periods, during which the timing signal provided to the output node is lower than ground;

ground discharge periods occurring immediately after the higher voltage periods and immediately before the lower voltage periods, during which the capacitance of the output node is discharged to ground; and ground precharge periods occurring immediately after the lower voltage periods and immediately before the higher voltage periods, during which the capacitance of the output node is precharged to ground;

wherein the timing circuitry comprises:

a lower voltage supply configured to provide the voltage lower than ground to the output node via a first switch and first slew rate control circuitry, wherein the first switch is configured to be activated during the lower voltage periods and the first slew rate control circuitry is configured to control a fall time of the timing signal from ground to the voltage lower than ground during the lower voltage periods;

a higher voltage supply configured to provide the voltage higher than ground to the output node via at least a second switch and second slew rate control circuitry, wherein the second switch is configured to be activated during the higher voltage periods and the second slew rate control circuitry is configured to control a rise time of the timing signal from ground to the voltage higher than ground during the higher voltage periods; and a ground voltage node configured to provide a ground voltage to the output node via at least a third switch and the first slew rate control circuitry, wherein the third switch is configured to be activated during the ground discharge periods and the ground precharge periods, and wherein the first slew rate control circuitry is configured to control a rise time of the timing signal from the voltage lower than ground to ground during the ground precharge periods and wherein the first slew rate control circuitry is configured to control a fall time of the timing signal from the voltage higher than ground to ground during the ground discharge periods.

2. The electronic display of claim 1, wherein the timing circuitry of the display driver circuitry comprises:

a lower voltage supply configured to provide the voltage lower than ground to the output node via at least a first switch, wherein the first switch is configured to be activated during the lower voltage periods;

a higher voltage supply configured to provide the voltage higher than ground to the output node via at least a second switch, wherein the second switch is configured to be activated during the higher voltage periods; and a ground voltage node configured to provide a ground voltage to the output node via at least a third switch, wherein the third switch is configured to be activated during the ground discharge periods and the ground precharge periods.

3. The electronic display of claim 1, wherein the timing circuitry is configured to output the timing signal via the output node to the circuitry of the display panel or the circuitry of the display driver circuitry via the output node, wherein the circuitry of the display panel comprises a plurality of thin film transistor gates configured to enable a respective plurality of pixels to be programmed when the thin film transistor gates become activated by the timing signal.

4. The electronic display of claim 1, wherein the timing circuitry is configured to output the timing signal via the output node to the circuitry of the display panel or the circuitry of the display driver circuitry via the output node, wherein the circuitry of the display driver comprises a plurality of image data demultiplexer switches configured to demultiplex image data provided to the electronic display with which to drive the display panel.

5. One or more tangible, non-transitory machine-readable media comprising instructions to:

cause a first switch of display driver circuitry of an electronic display to become activated during a higher voltage period, thereby outputting a voltage higher than ground to a plurality of display control switches in a display panel of the electronic display or in the display driver circuitry, or both, wherein the plurality of display control switches are coupled in parallel and collectively have a capacitance;

cause a second switch to become activated during a ground discharge period, the ground discharge period occurring immediately after the higher voltage period, thereby discharging to ground the capacitance of the plurality of display control switches;

cause a third switch to become activated during a lower voltage period, the lower voltage period occurring immediately after the ground discharge period, thereby outputting a voltage lower than ground to the plurality of display control switches;

cause a first slew rate control circuitry of the display driver circuitry to control a slew rate of changes in the voltage that is output to the plurality of display control switches by activating different switches of a first plurality of slew rate control switches such that the first slew rate control circuitry provides a different resistance; and cause a second slew rate control circuitry of the display driver circuitry to control a slew rate of changes in the voltage that is output to the plurality of display control switches by activating different switches of a second plurality of slew rate control switches such that the second slew rate control circuitry provides a different resistance.

6. The one or more machine-readable media of claim 5, comprising instructions to:

cause the second switch to become activated during a ground precharge period, the ground precharge period occurring immediately after the lower voltage period, thereby precharging to ground the capacitance of the plurality of display control switches; and repeat the instructions, wherein the higher voltage period occurs immediately after the ground precharge period.

7. The one or more machine-readable media of claim 5, wherein the instructions are configured to be executed by a processor of an electronic device in which the electronic display is installed.

8. The one or more machine-readable media of claim 5, wherein the instructions are configured to be executed by a microcontroller of the display driver circuitry.

9. A processor configured to generate multiplexed image data; and an electronic display configured to display the multiplexed image data, wherein the electronic display comprises first timing circuitry configured to control a plurality of demultiplexer switches to demultiplex the image data, wherein gates of the plurality of demultiplexer switches are coupled in parallel, wherein the plurality of demultiplexer switches have a collective capacitance, and wherein the first timing circuitry comprises:

a first switch coupled to slew rate control circuitry configured to be activated during a higher voltage period and to provide, when activated, a voltage higher than ground to the plurality of demultiplexer switches;

a second switch coupled to the slew rate control circuitry configured to be activated during a lower voltage period and to provide, when activated, a voltage lower than ground to the plurality of demultiplexer switches; and a third switch coupled to the slew rate control circuitry configured to become activated during a ground discharge period and a ground precharge period and to provide, when activated, a ground voltage to the plurality of demultiplexer switches;

wherein the higher voltage period is configured to occur immediately after the ground precharge period, the ground discharge period is configured to occur immediately after the higher voltage period, the lower voltage period is configured to occur immediately after the ground discharge period, and the ground precharge period is configured to occur immediately after the lower voltage period, and wherein the periods are configured to repeat;

wherein the slew rate control circuitry comprises shared slew rate control circuitry comprising:

a plurality of pass-gate slew rate control switches coupled to one another; and a plurality of resistances coupled in series to one another;

wherein an input of all of the plurality of pass-gate slew rate control switches is coupled to a common output of the first, second, and third switches and wherein an output of each of the plurality of pass-gate slew rate control switches is respectively coupled before or after one of the plurality of resistances, such that activating different switches of the plurality of pass-gate slew rate control switches causes the shared slew rate control circuitry to provide a different resistance.

10. The electronic device of claim 9, wherein the display driver circuitry comprises second timing circuitry configured to control a plurality of gates of thin film transistors of pixels of the electronic display, wherein the second timing circuitry has substantially the same structure as the first timing circuitry.

11. The electronic device of claim 9, wherein the electronic device comprises a notebook computer, a desktop computer, a handheld device, a tablet computer, a portable media device, a cellular phone, or any combination thereof.

12. The electronic device of claim 9, wherein the electronic display comprises a liquid crystal display or an organic light emitting display, or a combination thereof.

13. A timing circuit for providing a timing signal to control a plurality of gates of display control circuitry of an electronic display, the plurality of gates of the display control circuitry having a collective capacitance, the timing circuit comprising:

a first switch coupled between a positive voltage supply node and slew rate control circuitry;

a second switch coupled between a negative voltage supply node and the slew rate control circuitry; and a third switch coupled between a ground node and the slew rate control circuitry;

wherein the slew rate control circuitry is configured to output the timing control signal to the plurality of gates of the display control circuitry and control a slew rate of the timing signal;

wherein the slew rate control circuitry comprises:

first slew rate control circuitry coupled between the first switch and the plurality of gates of the display control circuitry, wherein the first slew rate control circuitry is configured to control a rise time of the timing signal output to the plurality of gates of the display when the first switch is activated following deactivation of the third switch; and second slew rate control circuitry coupled between the second switch and the plurality of gates of the display control circuitry and between the third switch and the plurality of gates of the display control circuitry, wherein the first slew rate control circuitry is configured to control:

a fall time of the timing signal output to the plurality of gates of the display when the second switch is activated following the deactivation of the third switch;

a fall time of the timing signal output to the plurality of gates of the display when the third switch is activated following deactivation of the first switch; and a rise time of the timing signal output to the plurality of gates of the display when the third switch is activated following deactivation of the second switch.

14. The timing circuit of claim 13, wherein the slew rate control circuitry comprises shared slew rate control circuitry coupled to a common output of the first switch, the second switch, and the third switch, and to the plurality of gates of the display control circuitry, wherein the shared slew rate control circuitry is configured to control:

a rise time of the timing signal output to the plurality of gates of the display when the first switch is activated following deactivation of the third switch;

a fall time of the timing signal output to the plurality of gates of the display when the second switch is activated following the deactivation of the third switch;

a fall time of the timing signal output to the plurality of gates of the display when the third switch is activated following deactivation of the first switch; and a rise time of the timing signal output to the plurality of gates of the display when the third switch is activated following deactivation of the second switch.

* * * * *